US005486298A

United States Patent [19]

Aso et al.

[11] Patent Number: 5,486,298

[45] Date of Patent: Jan. 23, 1996

[54] FIBER TREATMENT COMPOSITIONS

[75] Inventors: Takayuki Aso; Isao Ona; Masaru Ozaki, all of Chiba Prefecture, Japan

[73] Assignee: Dow Corning Toray Silicone Company, Ltd., Tokyo, Japan

[21] Appl. No.: 393,757

[22] Filed: Feb. 24, 1995

[30] Foreign Application Priority Data

Feb. 25, 1994 [JP] Japan ..... 6-052774

[51] Int. Cl.[6] ..... D06M 13/50; C08K 5/54

[52] U.S. Cl. ..... 252/8.6; 252/8.7; 252/8.75; 252/8.8; 106/287.1; 106/287.14; 8/115.56.115.6; 524/265; 524/267

[58] Field of Search ..... 524/265, 267; 252/8.6, 8.8, 49.6, 8.7, 8.75; 106/287.1, 287.14; 8/115.6, 115.56

[56] References Cited

U.S. PATENT DOCUMENTS 5,036,123 7/1991 Ozaki et al. ..... 524/267

FOREIGN PATENT DOCUMENTS

| | | |
|---|---|---|
| 42-008438 | 4/1967 | Japan . |
| 48-019893 | 3/1973 | Japan . |
| 53-081798 | 7/1978 | Japan . |
| 63-008233 | 2/1988 | Japan . |
| 03-14672 | 3/1991 | Japan . |
| 04-153316 | 9/1992 | Japan . |
| 05-125669 | 9/1993 | Japan . |

*Primary Examiner*—Anthony Green
*Attorney, Agent, or Firm*—Timothy J. Troy

[57] ABSTRACT

The present invention relates to a fiber treatment composition comprising a mixture of a dimethylpolysiloxane, a polyoxyalkylene-functional diorganopolysiloxane, and an amine-containing antioxidant or a phenol-containing antioxidant. The fiber treatment compositions of this invention exhibit excellent lubricity, static resistance, and long-term storage stability.

22 Claims, No Drawings

FIBER TREATMENT COMPOSITIONS

BACKGROUND OF THE INVENTION

The present invention relates to silicone compositions for application to fibers, threads, and filamentous materials. More specifically, the present invention relates to fiber treatment compositions that exhibit excellent lubricity, excellent static resistance, and long-term storage stability.

Dimethylpolysiloxane oils exhibit excellent heat resistance and lubricity and for this reason have been used widely as treatment agents, for example, as lubricants for spandex and mechanical sewing thread (a neat lubricant is solvent-free and water-free treatment agent containing 100% of the lubricant component). Various improved treatment agents have been developed over the last few years in order to generate additional improvements in the lubricity and static resistance of dimethylpolysiloxane oils. The inventors in Japanese Patent Application Laid Open No. 2-127569 (127,569/1990) have themselves already proposed such an improved treatment agents in the form of a fiber treatment composition comprising a dimethylpolysiloxane and an organopolysiloxane containing block copolymerized polyoxyalkylene groups.

However, turbidity or precipitation is produced during long-term exposure of this fiber treatment composition to air, and diminished properties are obtained for fiber and thread treated with the compositions in this state.

SUMMARY OF THE INVENTION

The present invention relates to a fiber treatment composition comprising a mixture of a dimethylpolysiloxane, a polyoxyalkylene-functional diorganopolysiloxane, and an amine-containing antioxidant or a phenol-containing antioxidant.

It is an object of the present invention to produce a fiber treatment composition that exhibits an excellent lubricity and static resistance as well as an excellent long-term storage stability.

It is a further object of this invention to produce a fiber treatment composition which has compatibility among its components.

It is another object of this invention to produce a fiber treatment composition which has a very low tendency to yellow any fibers treated with it.

DETAILED DESCRIPTION OF THE INVENTION

The present invention relates to a fiber treatment composition comprising: (A) 100 weight parts of dimethylpolysiloxane having a viscosity of 3 to 30 $mm^2/s$ at 25° C. and (B) 0.5 to 50 weight parts of a polyoxyalkylene-functional diorganopolysiloxane with the general formula:

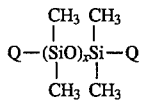

wherein Q is a group having the formula:

$$-RO(C_3H_6O)_a(C_2H_4O)_bR^1$$

wherein R denotes an alkylene group having from 2 to 5 carbon atoms, $R^1$ is a radical selected from the group consisting of a hydrogen atom, an alkyl group having from 1 to 6 carbon atoms, a $-COCH^3$ group, and $-COR^2COOH$ groups wherein $R^2$ is a divalent hydrocarbon group having from 1 to 15 carbon atoms, a has a value of 1 to 15, b has a value of 1 to 15, with the proviso that the ratio of a to b is from 0.1 to 10, the units expressed by $(C_3H_{64}O)_a$ in the formula constitute a block, the units expressed by $(C_2H_4O)_b$ constitute a block, and x has a value of at least 1, and (C) 0.003 to 1 weight parts of an amine-containing antioxidant, a phenol-containing antioxidant, or a mixture thereof.

The dimethylpolysiloxane comprising component (A) functions to impart lubricity to the fiber, thread, or filamentous material. This component should have a viscosity of 3 to 30 $mm^2/s$ at 25° C. because the lubricity becomes inadequate at a viscosity below 3 $mm^2/s$ and too much of component (A) will be taken up by the fiber when the viscosity exceeds 30 $mm^2/s$. This component may have a straight-chain, partially branched straight-chain, or cyclic molecular structure. In the case of straight-chain structures, the molecular chain terminal group is typically trimethylsiloxy or dimethylhydroxylsiloxy. This component cannot have a polyoxyalkylene group at the molecular chain terminals.

The polyoxyalkylene-functional diorganopolysiloxane (B), which is compatible with component (A), functions to impart an excellent static resistance to the fiber. The group R in the above formula for (B) denotes an alkylene group having from 2 to 5 carbon atoms and is exemplified by ethylene, propylene, butylene, isobutylene, and pentylene. The alkyl groups of $R^1$ in the formula for (B) are exemplified by methyl, ethyl, propyl, isopropyl, n-butyl, isobutyl, and n-pentyl. The group $R^1$ is preferably selected from hydrogen, methyl, or a $-COCH_3$ group. The group $R^2$ in the above formula for (B) is exemplified by alkylene groups such as ethylene and propylene, alkenylene groups such as vinylene and propenylene, arylene groups such as phenylene, and a group having the formula:

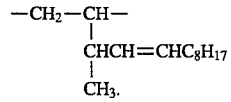

The subscript a in the above formula for (B) is 1 to 15 and preferably 3 to 10, and the subscript b is 1 to 15 and preferably 3 to 10. The ratio of a to b is from 0.1 to 10. The units expressed by $(C_3H_6O)_a$ in the formula above constitute a block, the units expressed by $(C_2H_4O)_b$ constitute a block, and the order of bonding of these oxyalkylene unit blocks corresponds to that specified by the formula above. The subscript x in the formula for component (B) is an integer with a value of at least 1.

The polyoxyalkylene-functional diorganopolysiloxane of (B) has a characteristic molecular structure in which the propylene oxide units in its polyoxyalkylene functionalities are positioned as blocks at the ends of the organopolysiloxane and the ethylene oxide units are positioned as blocks at the ends of the propylene oxide blocks, remote from the organopolysiloxane. Investigations by the inventors have shown that this particular structure for the polyoxyalkylene functionality provides an improved compatibility with the dimethylpolysiloxane (A).

The diorganopolysiloxane comprising this component can be synthesized, for example, by first running an addition reaction between an unsaturated alcohol (such as allyl alcohol) and a specified number of moles of propylene oxide and then running an addition reaction with a specified number of moles of ethylene oxide to give the unsaturated polyoxyalkylene. The target diorganopolysiloxane is subsequently obtained by addition-reacting this unsaturated polyoxyalkylene with SiH-containing organohydrogenpolysiloxane using, for example, a platinum catalyst.

Component (B) should be added at 0.5 to 50 weight parts per 100 weight parts component (A) and is preferably added at 3 to 10 weight parts. The optimal range of addition is 5 to 20 weight parts when static resistance is of particular importance.

Component (C) is an amine-based or phenol-based antioxidant and is the component that provides high-temperature stability and an improved long-term storage stability. The amine-based antioxidants are exemplified by compounds such as N,N-di(nonylphenyl)amine, diaryldiamines such as N,N'-diphenylethylenediamine or N,N'-ditolylethylenediamine, naphthylamines such as N-phenyl-1-naphthylamine or N-phenyl-2-naphthylamine, aromatic amines such as N,N'-diisobutyl-p-phenylenediamine, N-cyclohexyl-N'-phenyl-p-phenylenediamine, N,N'-dinaphthyl-p-phenylenediamine, N,N'-ditolyl-p-phenylenediamine, N,N'-diphenyl-p-phenylenediamine, 6-ethoxydihydroquinoline, 4-isopropoxydiphenylamine, and alkylated diphenylamines; and an alpha-omega-N,N-diphenylamine-dimethylsiloxane copolymer having the formula:

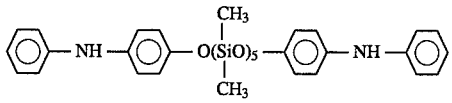

The phenol-based antioxidants are exemplified by bisphenol compounds having the general formula:

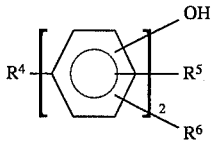

wherein $R^4$ is selected from a sulfur atom or a divalent hydrocarbon group, and $R^5$ and $R^6$ independently denote alkyl groups. The divalent hydrocarbon groups of $R^4$ are exemplified by alkylenearylene groups and alkylene groups such as methylene, methylmethylene, propylmethylene, ethylene, propylene, and butylene. The groups $R^5$ and $R^6$ are exemplified by alkyl groups such as methyl, ethyl, propyl, butyl, isobutyl, tert-butyl, and octyl. In addition to bisphenol compounds with the preceding formula, phenol-based antioxidants are also exemplified by monophenols, polyphenols, and aminophenols. The phenol-based antioxidants under consideration are specifically exemplified by 2,2'-methylenebis(4-methyl-6-tert-butylphenol), 4,4'-methylenebis(2,6-di-tert-butylphenol), 4,4'-butylidenebis(3-methyl-6-tert-butylphenol), 4,4'-thiobis(3-methyl-6-tert-butylphenol), 4-tert-butylpyrocatechol, monomethyl ether of hydroquinone, 2,6-di-tert-butyl-p-cresol, 1,1,3-tris(2-methyl-4-hydroxy-5-tert-butylphenyl)butane, and 2,4,6-tetraaminophenol.

Component (C) may comprise a single antioxidant or a mixture of antioxidants selected from the antioxidants described above. Component (C) is added at 0.003 to 1 weight part and preferably 0.01 to 0.1 weight part per 100 weight parts component (A). Additions of less than 0.003 weight part cannot improve the long-term storage stability of the compositions of this invention, while additions in excess of 1 weight part can cause a moderate discoloration of the compositions of this invention and can negatively impact the properties (such as the lubricity) of the treated fiber.

The compositions of this invention are composed of components (A), (B), and (C) as discussed above, but additives other than these components may be present insofar as the object of the invention is not adversely affected. Said other additives are exemplified by rust inhibitors and organopolysiloxanes other than those comprising components (A) and (B).

The composition of the present invention is prepared simply by the ordinary mixing of components (A), (B), and (C). Mixing by itself will yield a transparent liquid in which components (A), (B), and (C) are compatible.

The compatibility among components (A), (B), and (C) is excellent in a neat fiber treatment composition of the present invention as described hereinbefore. Another advantage of the instant composition is its very low tendency to yellow fiber treated with it.

Fibers may be treated with the compositions, for example, by immersion in a treatment bath of the compositions of the invention followed by roll expression, by bringing the running fiber or thread into contact with pick-up rolls, or by spraying. The generally preferred add-on amount for the compositions of this invention is from 0.05 to 7.0 weight % of diorganopolysiloxane based on fiber, while the particularly preferred add-on range is from 0.5 to 5.0 weight %. A uniform treatment of the fiber or thread can be obtained when heat treatment is carried out after application of the compositions of the invention to the fiber.

Fibers which can be treated with compositions of the invention are exemplified by natural fibers such as wool, silk, flax, cotton, angora, and mohair; regenerated fibers such as rayon and bemberg; semisynthetic fibers such as acetate; and synthetic fibers such as polyester, polyamide, polyacrylonitrile, polyvinyl chloride, vinylon, polyethylene, polypropylene, and spandex. As used herein, fiber refers to continuous filament thread or yarn, spun yarn, or tow.

In the examples hereinbelow, "parts" denotes "weight parts", "%" denotes "weight %", and the viscosity is the value ($mm^2$/sec.(s)) at 25° C. The long-term storage stability and compatibility (immediately after preparation and after standing for 1 week) were measured by the following methods: Long-term storage stability After preparation, 100 cc of the neat fiber treatment composition was placed in a glass bottle and held in a hot-air drier at 105° C. The appearance was inspected visually after a specified period of time (at 2 hours and 4 hours), and the long-term storage stability was rated according to the following scale:

++: denotes transparent (transmittance at least 90%)

+: denotes a very slight turbidity (70 to 90% transmittance)

×: denotes white turbidity (transmittance below 70%)

Compatibility

Immediately after preparation, 100 cc of the neat fiber treatment composition was placed in a glass bottle and its appearance was visually inspected. The compatibility immediately after preparation was rated according to the following scale:

++: denotes a homogeneous dissolution/dispersion, transparent

+: denotes a slight white turbidity

×: denotes significant white turbidity

The neat fiber treatment composition was then held in the glass bottle for 1 week at 25° C., at which point its appearance was again visually inspected. The compatibility after standing for 1 week was rated according to the following scale:

++: denotes a homogeneous dissolution/dispersion, transparent

+: denotes a slight separation

×: denotes a complete separation

EXAMPLE 1

Ten diorganopolysiloxanes having the following formulae were synthesized:

$$HO(C_2H_4O)_5(C_3H_6O)_5C_3H_6-(\overset{CH_3}{\underset{CH_3}{Si}}O)_{100}\overset{CH_3}{\underset{CH_3}{Si}}-C_3H_6(OC_3H_6)_5(OC_2H_4)_5OH \quad (A)$$

having a viscosity of about 748 $mm^2/s$ (the ethylene oxide units and propylene oxide units in the preceding formula were block copolymerized);

$$HO(C_2H_4O)_5(C_3H_6O)_5C_3H_6-(\overset{CH_3}{\underset{CH_3}{Si}}O)_{50}\overset{CH_3}{\underset{CH_3}{Si}}-C_3H_6(OC_3H_6)_5(OC_2H_4)_5OH \quad (B)$$

having a viscosity of about 478 $mm^2/s$ (the ethylene oxide units and propylene oxide units in the preceding formula were block copolymerized);

$$HOC(=O)(CH_2)_2C(=O)O(C_2H_4O)_5(C_3H_6O)_5C_3H_6-(\overset{CH_3}{\underset{CH_3}{Si}}O)_{90}\overset{CH_3}{\underset{CH_3}{Si}}-C_3H_6-(OC_3H_6)_5(OC_2H_4)_5OC(=O)(CH_2)_2C(=O)OH \quad (C)$$

having a viscosity of about 2110 $mm^2/s$ (the ethylene oxide units and propylene oxide units in the preceding formula were block copolymerized);

$$HOC(=O)(CH_2)_2C(=O)O(C_2H_4O)_5(C_3H_6O)_5C_3H_6-(\overset{CH_3}{\underset{CH_3}{Si}}O)_{60}\overset{CH_3}{\underset{CH_3}{Si}}-C_3H_6-(OC_3H_6)_5(OC_2H_4)_5OC(=O)(CH_2)_2C(=O)OH \quad (D)$$

having a viscosity of about 1521 $mm^2/s$ (the ethylene oxide units and propylene oxide units in the preceding formula were block copolymerized);

$$HO(C_2H_4O)_5(C_3H_6O)_5C_3H_6-(\overset{CH_3}{\underset{CH_3}{Si}}O)_{100}\overset{CH_3}{\underset{CH_3}{Si}}-C_3H_6(OC_2H_4)_5(OC_3H_6)_5OH \quad (E)$$

having a viscosity of about 536 $mm^2/s$ (the ethylene oxide units and propylene oxide units in the preceding formula were randomly copolymerized);

$$HO(C_2H_4O)_{12}-C_3H_6-(\overset{CH_3}{\underset{CH_3}{Si}}O)_{100}\overset{CH_3}{\underset{CH_3}{Si}}-C_3H_6-(OC_2H_4)_{12}OH \quad (F)$$

having a viscosity of about 3820 $mm^2/s$;

$$HO(C_2H_4O)_5-C_3H_6-(\overset{CH_3}{\underset{CH_3}{Si}}O)_{100}\overset{CH_3}{\underset{CH_3}{Si}}-C_3H_6-(OC_2H_4)_5OH \quad (G)$$

having a viscosity of about 284 $mm^2/s$;

$$(CH_3)_3-SiO(\overset{CH_3}{\underset{CH_3}{Si}}O)_{400}(\overset{CH_3}{\underset{C_3H_6NHC_2H_4NH_2}{Si}}O)_8Si-(CH_3)_3 \quad (H)$$

having a viscosity of about 1200 $mm^2/s$;

(I) the partial hydrolyzate-condensate of $C_4H_9Si(OCH_3)_3$ having a viscosity of about 23,000 $mm^2/s$;

$$HO(C_3H_6O)_5(C_2H_4O)_5C_3H_6-(\overset{CH_3}{\underset{CH_3}{Si}}O)_{100}\overset{CH_3}{\underset{CH_3}{Si}}-C_3H_6(OC_2H_4)_5(OC_3H_6)_5OH \quad (J)$$

having a viscosity of about 425 $mm^2/s$ (the ethylene oxide units and propylene oxide units in the preceding formula were block copolymerized).

The following compounds were used as antioxidants:

(K) N,N-di(nonylphenyl)amine:

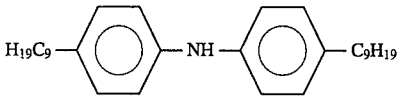

(L) alpha,omega-N,N-diphenylamine-dimethylsiloxane copolymer with the following formula:

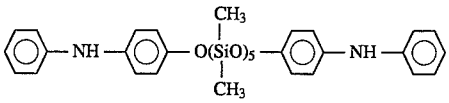

(M) monomethyl ether of hydroquinone:

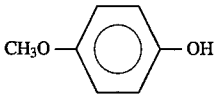

(N) 4-tert-butylpyrocatechol:

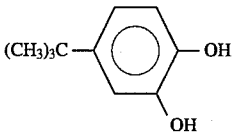

Neat fiber treatment compositions No. 1 through No. 11 were respectively prepared using the recipes given in Table I by combining trimethylsiloxy-terminated dimethylpolysiloxane (having viscosity of either 10 or 20 $mm^2/s$), a diorganopolysiloxane (A) to (D), and an antioxidant (K) to (N) and mixing for 15 minutes. The long-term storage stability (at 2 hours and 4 hours) and compatibility (immediately after preparation and after standing for 1 week) were measured on each neat fiber treatment composition thus prepared. The volume resistivity was also measured immediately after preparation using the method stipulated in JIS C 2101, entitled "Volume Resistivity Testing", and a volume resistivity meter from the Hewlett-Packard Corporation (US). The various results are reported in Table II. Table III reports a general evaluation of each composition in terms of it suitability as a fiber treatment composition.

Comparative Example 1

Neat fiber treatment compositions No. 12 to No. 25 were respectively prepared using the recipes given in Table I by combining trimethylsiloxy-terminated dimethylpolysiloxane (having a viscosity of about 10 or 20 $mm^2/s$) and a diorganopolysiloxane (A) to (J) and mixing for 15 minutes. The long-term storage stability (at 2 hours and 4 hours) and compatibility (immediately after preparation and after standing for 1 week) were measured on each comparative neat fiber treatment composition thus prepared. The volume resistivity was also measured immediately after preparation using the method specified in Example 1. The various results are reported in Table II. Table III reports a general evaluation of each composition in terms of its suitability as a neat fiber treatment composition.

TABLE I

| | dimethyl polysiloxane (parts) | | diorganopolysiloxane (parts) | | | | | | | | | | antioxidant (parts) | | | |
|---|---|---|---|---|---|---|---|---|---|---|---|---|---|---|---|---|
| | 10 $mm^2$/sec. | 20 $mm^2$/sec. | A | B | C | D | E | F | G | H | I | J | K | L | M | N |
| Ex. 1 | | | | | | | | | | | | | | | | |
| No. 1 | 100 | | 1 | | | | | | | | | | 0.1 | | | |
| No. 2 | 100 | | 1 | | | | | | | | | | | 0.1 | | |
| No. 3 | 100 | | 1 | | | | | | | | | | | | 0.1 | |
| No. 4 | 100 | | 1 | | | | | | | | | | | | | 0.1 |
| No. 5 | 100 | | 3 | | | | | | | | | | 0.1 | | | |
| No. 6 | 100 | | 5 | | | | | | | | | | 0.1 | | | |
| No. 7 | 100 | | 10 | | | | | | | | | | 0.1 | | | |
| No. 8 | 100 | | 20 | | | | | | | | | | 0.1 | | | |
| No. 9 | | 100 | | 10 | | | | | | | | | 0.1 | | | |
| No. 10 | | 100 | | | 10 | | | | | | | | 0.1 | | | |
| No. 11 | | 100 | | | | 10 | | | | | | | 0.1 | | | |
| Comp. Ex. 1 | | | | | | | | | | | | | | | | |
| No. 12 | 100 | | 1 | | | | | | | | | | | | | |
| No. 13 | 100 | | 3 | | | | | | | | | | | | | |
| No. 14 | 100 | | 5 | | | | | | | | | | | | | |
| No. 15 | 100 | | 10 | | | | | | | | | | | | | |
| No. 16 | 100 | | 20 | | | | | | | | | | | | | |
| No. 17 | | 100 | | 10 | | | | | | | | | | | | |
| No. 18 | | 100 | | | 10 | | | | | | | | | | | |

TABLE I-continued

| | dimethyl polysiloxane (parts) | | | | | | | | | | | | | | | |
|---|---|---|---|---|---|---|---|---|---|---|---|---|---|---|---|---|
| | 10 $mm^2$/ | 20 $mm^2$/ | diorganopolysiloxane (parts) | | | | | | | | | | antioxidant (parts) | | | |
| | sec. | sec. | A | B | C | D | E | F | G | H | I | J | K | L | M | N |
| No. 19 | | 100 | | | | 10 | | | | | | | | | | |
| No. 20 | 100 | | | | | | 5 | | | | | | | | | |
| No. 21 | 100 | | | | | | | 5 | | | | | | | | |
| No. 22 | 100 | | | | | | | | 5 | | | | | | | |
| No. 23 | 100 | | | | | | | | | 5 | | | | | | |
| No. 24 | 100 | | | | | | | | | | 5 | | | | | |
| No. 25 | 100 | | | | | | | | | | | 5 | | | | |

TABLE II

| | compatibility | | | | |
|---|---|---|---|---|---|
| | immediately after preparation | after standing for 1 week | volume resistivity ohm-cm | long-term storage stability 2 hours | long-term storage stability 4 hours |
| Ex. 1 | | | | | |
| No. 1 | ++ | ++ | $8.8 \times 10^{10}$ | ++ | ++ |
| No. 2 | ++ | ++ | $8.8 \times 10^{10}$ | ++ | ++ |
| No. 3 | ++ | ++ | $8.8 \times 10^{10}$ | ++ | ++ |
| No. 4 | ++ | ++ | $8.8 \times 10^{10}$ | ++ | ++ |
| No. 5 | ++ | ++ | $7.0 \times 10^{10}$ | ++ | ++ |
| No. 6 | ++ | ++ | $4.6 \times 10^{10}$ | ++ | ++ |
| No. 7 | ++ | ++ | $1.7 \times 10^{10}$ | ++ | ++ |
| No. 8 | ++ | ++ | $1.6 \times 10^{10}$ | ++ | ++ |
| No. 9 | ++ | ++ | $5.1 \times 10^{10}$ | ++ | ++ |
| No. 10 | ++ | ++ | $9.6 \times 10^{9}$ | ++ | ++ |
| No. 11 | ++ | ++ | $7.2 \times 10^{9}$ | ++ | ++ |
| Comp. Ex. 1 | | | | | |
| No. 12 | ++ | ++ | $8.8 \times 10^{10}$ | x | x |
| No. 13 | ++ | ++ | $7.0 \times 10^{10}$ | x | x |
| No. 14 | ++ | ++ | $4.6 \times 10^{10}$ | x | x |
| No. 15 | ++ | ++ | $1.7 \times 10^{10}$ | x | x |
| No. 16 | ++ | ++ | $1.6 \times 10^{10}$ | x | x |
| No. 17 | ++ | ++ | $5.1 \times 10^{10}$ | x | x |
| No. 18 | ++ | ++ | $9.6 \times 10^{9}$ | x | x |
| No. 19 | ++ | ++ | $7.2 \times 10^{9}$ | x | x |
| No. 20 | + | x | $3.3 \times 10^{11}$ | x | x |
| No. 21 | x | x | $2.8 \times 10^{11}$ | x | x |
| No. 22 | ++ | ++ | $5.5 \times 10^{12}$ | x | x |
| No. 23 | ++ | ++ | $3.3 \times 10^{13}$ | x | x |
| No. 24 | ++ | ++ | $6.2 \times 10^{12}$ | x | x |
| No. 25 | + | + | $3.8 \times 10^{11}$ | x | x |

TABLE III

| General Evaluation | |
|---|---|
| Example 1 | |
| No. 1 | excellent |
| No. 2 | excellent |
| No. 3 | excellent |
| No. 4 | excellent |
| No. 5 | excellent |
| No. 6 | excellent |
| No. 7 | excellent |
| No. 8 | excellent |
| No. 9 | excellent |
| No. 10 | excellent |
| No. 11 | excellent |

TABLE III-continued

| General Evaluation | |
|---|---|
| Comparative Example 1 | |
| No. 12 | unsuitable due to unsatisfactory long-term storage stability |
| No. 13 | unsuitable due to unsatisfactory long-term storage stability |
| No. 14 | unsuitable due to unsatisfactory long-term storage stability |
| No. 15 | unsuitable due to unsatisfactory long-term storage stablity |
| No. 16 | unsuitable due to unsatisfactory long-term storage stability |
| No. 17 | unsuitable due to unsatisfactory long-term storage stability |
| No. 18 | unsuitable due to unsatisfactory long-term storage stability |
| No. 19 | unsuitable due to unsatisfactory long-term storage stability |
| No. 20 | unsuitable due to unsatisfactory compatibility |
| No. 21 | unsuitable due to very low compatibility |
| No. 22 | unsuitable due to unsatisfactory static resistance |
| No. 23 | unsuitable due to unsatisfactory static resistance |
| No. 24 | unsuitable due to unsatisfactory static resistance |
| No. 25 | unsuitable due to unsatisfactory compatibility |

EXAMPLE 2

Woolly-processed nylon sewing machine thread was fluorescent whitened and then taken up to a skein, which was subsequently immersed in neat fiber treatment composition No. 6 see Example 1). Adjustment to a 5.5% diorganopolysiloxane add-on using a centrifugal dehydrator yielded a treated sewing machine thread. This thread was uniformly wrapped around each of 5 sheets of thick paper (3 cm×5 cm×0.2 cm). Four of these wrapped specimens were installed in a Kyodai Kaken rotary static tester, and the triboelectrification voltage was measured after 60 seconds while rotating the rotator at 800 rpm and using 100% cotton unbleached muslin #3 as the friction fabric. After one-half of the remaining wrapped specimen had been covered with black paper, the specimen was irradiated for 3 hours using a Fade-O-meter ageing tester. The yellowing (grade) caused by this exposure was evaluated using the evaluation method stipulated in JIS L 0804, entitled "Gray Scale for Discoloration and Color Fading". The obtained results are reported in Table IV. Table IV also reports a general evaluation of the neat fiber treatment composition in terms of its performance as a treatment agent for sewing machine thread.

Comparative Example 2

The triboelectrification voltage and yellowing (grade) of neat fiber treatment compositions No. 14 and No. 23 (see Comparative Example 1) were measured according to the procedure described in Example 2. The obtained results are reported in Table IV, which also reports a general evaluation of the neat fiber treatment compositions in terms of their performance as a treatment agent for sewing machine thread.

TABLE IV

| | triboelectrification voltage (V) | yellowing (grade) | general evaluation |
|---|---|---|---|
| Example 2 No. 6 | 870 | 4 | satisfactory |
| Comparative Example 2 | | | |
| No. 14 | 870 | 4 | unsuitable due to an unsatisfactory long-term storage stability |
| No. 23 | 1260 | 2 | unsuitable due to fairly substantial yellowing |

EXAMPLE 3

A neat fiber treatment composition was prepared by combining 100 parts of trimethylsiloxy-terminated dimethylpolysiloxane having a viscosity of about 5 $mm^2/s$, 10 parts of a polyoxyalkylene-functional diorganopolysiloxane having the formula:

$$HO(C_2H_4O)_5(C_3H_6O)_{10}C_3H_6-(\overset{CH_3}{\underset{CH_3}{Si}}O)_{90}\overset{CH_3}{\underset{CH_3}{Si}}-C_3H_6(OC_3H_6)_{10}(OC_2H_4)_5OH$$

having a viscosity of about 1020 $mm^2/s$ (the ethylene oxide units and propylene oxide units in the preceding formula were block copolymerized), and 0.01 part N,N-di(nonylphenyl)amine (see (K) in Example 1) and mixing for 15 minutes. The long-term storage stability (at 4 hours) and volume resistivity of this neat fiber treatment composition were measured as in Example 1. The obtained results are reported in Table V, which also reports a general evaluation of the neat fiber treatment composition in terms of its performance as a treatment agent for spandex.

Comparative Example 3

A neat fiber treatment composition was prepared using the procedure of Example 3, but in this case omitting the N,N-di(nonylphenyl)amine used in Example 3. The long-term storage stability (at 4 hours) and volume resistivity of this neat fiber treatment composition were measured as in Example 3. The obtained results are reported in Table V, which also reports a general evaluation of the neat fiber treatment composition in terms of its performance as a treatment agent for spandex.

EXAMPLE 4

A neat fiber treatment composition was prepared according to the procedure of Example 3, but in the present case using a polyoxyalkylene-functional diorganopolysiloxane having the formula:

$$HO(C_2H_4O)_5(C_3H_6O)_3C_3H_6-(\overset{CH_3}{\underset{CH_3}{Si}}O)_{90}\overset{CH_3}{\underset{CH_3}{Si}}-C_3H_6(OC_3H_6)_3(OC_2H_4)_5OH$$

having a viscosity of about 584 $mm^2/s$ (the ethylene oxide units and propylene oxide units in the preceding formula were block copolymerized) in place of the polyoxyalkylene-functional diorganopolysiloxane with a viscosity of 1020 $mm^2/s$ that was used in Example 3. The long-term storage stability (at 4 hours) and volume resistivity of this neat fiber treatment composition were measured as in Example 3. The obtained results are reported in Table V, which also reports a general evaluation of the neat fiber treatment composition in terms of its performance as a treatment agent for spandex.

Comparative Example 4

A neat fiber treatment composition was prepared using the procedure of Example 4, but in this case omitting the N,N-di(nonylphenyl)amine (see (K) in Example 1) that was used in Example 4. The long-term storage stability (at 4 hours) and volume resistivity of this neat fiber treatment composition were measured as in Example 4. The obtained results are reported in Table V, which also reports a general evaluation of the neat fiber treatment composition in terms of its performance as a treatment agent for spandex.

TABLE V

| | volume resistivity (ohm-cm) | long-term storage stability (4 hours) | general evaluation |
|---|---|---|---|
| Example 3 | $2.3 \times 10^{10}$ | + + | satisfactory |
| Example 4 | $5.1 \times 10^{11}$ | + + | satisfactory |
| Comparative Example 3 | $2.3 \times 10^{10}$ | x | unsuitable due to an unsatisfactory long-term storage stability |
| Comparative Example 4 | $5.1 \times 10^{11}$ | x | unsuitable due to an unsatisfactory long-term storage stability |

EXAMPLE 5

A neat fiber treatment composition was prepared by combining 100 parts of trimethylsiloxy-terminated dimethylpolysiloxane having a viscosity of about 5 $mm^2/s$, 10 parts of a polyoxyalkylene-functional diorganopolysiloxane having the formula:

$$CH_3O(C_2H_4O)_5(C_3H_6O)_3C_3H_6-(\overset{CH_3}{\underset{CH_3}{Si}}O)_{90}\overset{CH_3}{\underset{CH_3}{Si}}-C_3H_6(OC_3H_6)_3(OC_2H_4)_5OCH_3$$

having a viscosity of about 430 $mm^2/s$ (the ethylene oxide units and propylene oxide units in the preceding formula were block copolymerized), and 0.01 part N,N-di(nonylphenyl)amine (see (K) in Example 1) and mixing for 15 minutes. The long-term storage stability (at 4 hours) and compatibility (immediately after preparation and after standing for 1 week) of the resulting neat fiber treatment composition were measured with the following results, respectively: the transmittance was at least 90%, and a homogeneous dissolution/dispersion and a transparent product were observed from immediately after preparation up to after 1 week of standing. The volume resistivity, measured as in Example 1, was $8.5\times10^{11}$ ohm-cm. These results confirmed that this neat fiber treatment composition exhibited excellent static resistance and was well qualified for application as a spandex treatment agent.

EXAMPLE 6

A neat fiber treatment composition was prepared by combining 100 parts of trimethylsiloxy-terminated dimethylpolysiloxane having a viscosity of about 5 $mm^2/s$, 10 parts of a polyoxyalkylene-functional diorganopolysiloxane having the formula:

$$CH_3C(=O)O(C_2H_4O)_5(C_3H_6O)_{10}C_3H_6-(\overset{CH_3}{\underset{CH_3}{Si}}O)_{90}\overset{CH_3}{\underset{CH_3}{Si}}-{}_3H_6(OC_3H_6)_{10}(OC_2H_4)_5OC(=O)CH_3$$

having a viscosity of about 460 $mm^2/s$ (the ethylene oxide units and propylene oxide units in the preceding formula were block copolymerized), and 0.01 part N,N-di(nonylphenyl)amine (see (K) in Example 1) and mixing for 15 minutes. The long-term storage stability (at 4 hours) and compatibility (immediately after preparation and after standing for 1 week) of the resulting neat fiber treatment composition were measured with the following homogeneous dissolution/dispersion and a transparent product were observed from immediately after preparation up to after 1 week of standing. The volume resistivity, measured as in Example 1, was $7.3\times10^{11}$ ohm-cm. These results confirmed that this neat fiber treatment composition exhibited an excellent static resistance and was well qualified for application as a spandex treatment agent.

EXAMPLE 7

Respective neat fiber treatment compositions were prepared by combining 100 parts of trimethylsiloxy-terminated dimethylpolysiloxane having a viscosity of about 10 $mm^2/s$, 10 parts of polyoxyalkylene-functional diorganopolysiloxane (A) synthesized in Example 1, and N,N-di(nonylphenyl)amine (see (K) in Example 1) in the amount reported in Table VI (0.01 part, 0.1 part, and 1.0 part) and mixing to homogeneity over 15 minutes. The long-term storage stability (4 hours), compatibility (immediately after preparation and after standing for 1 week), and appearance (color) of the neat fiber treatment compositions were evaluated, and the obtained results are reported in Table VI. Table VI also reports a general evaluation of these neat fiber treatment compositions in terms of their performance as spandex treatment agents.

Comparative Example 5

Respective neat fiber treatment compositions were prepared according to the procedure of Example 7, but in the present case using the quantities of addition reported in Table VI (0 part, 0,001 part, and 5.0 parts) for the N,N-di(nonylphenyl)amine (see (K) in Example 1). The long-term storage stability (at 4 hours), compatibility (immediately after preparation and after standing for 1 week), and appearance (color) of the neat fiber treatment compositions were evaluated, and the obtained results are reported in Table VI. Table VI also reports a general evaluation of these neat fiber treatment compositions in terms of their performance as spandex treatment agents.

TABLE VI

| | compatibility | | | Long-term | |
|---|---|---|---|---|---|
| | immediately after preparation | after standing for 1 week | appearance (color) | storage stability (at 4 hours) | general evaluation |
| Example 7 antioxidant addition | | | | | |
| 0.01 part | + + | + + | colorless; transparent | + + | satisfactory |
| 0.1 part | + + | + + | colorless; transparent | + + | satisfactory |
| 1.0 part | + + | + + | colorless; transparent | + + | satisfactory |

TABLE VI-continued

| | compatibility | | | Long-term | |
|---|---|---|---|---|---|
| | immediately after preparation | after standing for 1 week | appearance (color) | storage stability (at 4 hours) | general evaluation |
| Comp. Example 5 antioxidant addition | | | | | |
| 0 part | + + | + + | colorless; transparent | x | unsuitable due to inadequate long-term storage stability |
| 0.001 part | + + | + + | colorless; transparent | x | unsuitable due to inadequate long-term storage stability |
| 5.0 parts | + + | + + | brown; transparent | + + | unsuitable due to discoloration |

That which is claimed is:

1. A fiber treatment composition comprising:

(A) 100 weight parts of dimethylpolysiloxane having a viscosity of 3 to 30 $mm^2/s$ at 25° C.;

(B) 0.5 to 50 weight parts of a polyoxyalkylene-functional diorganopolysiloxane having the formula:

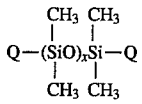

wherein Q is a group having the formula:

$$-RO(C_3H_6O)_a(C_2H_4O)_bR^1$$

wherein R denotes an alkylene group having from 2 to 5 carbon atoms, $R^1$ is a radical selected from the group consisting of a hydrogen atom, an alkyl group having from 1 to 6 carbon atoms, a $-COCH^3$ group, and $-COR^2COOH$ groups wherein $R^2$ is a divalent hydrocarbon group having from 1 to 15 carbon atoms, a has a value of 1 to 15, b has a value of 1 to 15, with the proviso that the ratio of a to b is from 0.1 to 10, the units expressed by $(C_3H_6O)_a$ in the formula constitute a block, the units expressed by $(C_2H_4O)_b$ constitute a block, and x has a value of at least 1; and (C) 0.003 to 1 weight parts of an antioxidant selected from the group consisting of:

(i) an amine-containing antioxidant;

(ii) a phenol-containing antioxidant; and (iii) a mixture of (i) and (ii).

2. A composition according to claim 1, wherein R is selected from the group consisting of ethylene, propylene, butylene, isobutylene, and pentylene.

3. A composition according to claim 1, wherein $R^1$ is selected from the group consisting of methyl, ethyl, propyl, isopropyl, n-butyl, isobutyl, and n-pentyl.

4. A composition according to claim 1, wherein $R^1$ is selected from the group consisting of hydrogen, methyl, and a $-COCH^3$ group.

5. A composition according to claim 1, wherein $R^2$ is selected from the group consisting of alkylene groups, alkenylene groups, arylene groups, and a group having the formula:

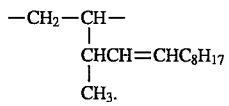

6. A composition according to claim 5, wherein the alkylene groups are selected from ethylene or propylene.

7. A composition according to claim 5, wherein the alkenylene groups are selected from vinylene or propenylene.

8. A composition according to claim 1, wherein a has a value of 3 to 10 and b has a value of 3 to 10.

9. A composition according to claim 1, wherein (i) is selected from the group consisting of N,N-di(nonylphenyl)amine, diaryldiamines, naphthylamines, aromatic amines, and an alpha-omega-N,N-diphenylamine-dimethylsiloxane copolymer having the formula:

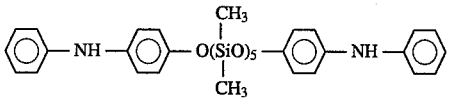

10. A composition according to claim 9, wherein the diaryldiamines are selected from N,N'-diphenylethylenediamine or N,N'-ditolylethylenediamine.

11. A composition according to claim 9, wherein the naphthylamines are selected from N-phenyl-1-naphthylamine or N-phenyl-2-naphthylamine.

12. A composition according to claim 9, wherein the aromatic amines are selected from the group consisting of N,N'-diisobutyl-p-phenylenediamine, N-cyclohexyl-N'-phenyl-p-phenylenediamine, N,N'-dinaphthyl-p-phenylenediamine, N,N'-ditolyl-p-phenylenediamine, N,N'-diphenyl-p-phenylenediamine, 6-ethoxydihydroquinoline, 4-isopropoxydiphenylamine, and alkylated diphenylamines.

13. A composition according to claim 1, wherein (ii) is a bisphenol compound having the general formula:

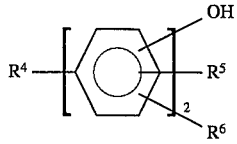

wherein $R^4$ is selected from a sulfur atom or a divalent hydrocarbon group, and $R^5$ and $R^6$ independently denote alkyl groups.

14. A composition according to claim 13, wherein $R^4$ selected from alkylenearylene groups or alkylene groups.

15. A composition according to claim 14, wherein the alkylene groups are selected from methylene, methylmethylene, propylmethylene, ethylene, propylene, or butylene.

16. A composition according to claim 13, wherein $R^5$ and $R^6$ are each independently selected from methyl, ethyl, propyl, butyl, isobutyl, tert-butyl, or octyl.

17. A composition according to claim 1, wherein (ii) is selected from the group consisting of monophenols, polyphenols, and aminophenols.

18. A composition according to claim 1, wherein (ii) is selected from the group consisting of 2'-methylenebis(4-methyl-6-tert-butylphenol), 4,4'-methylenebis(2,6-di-tert-butylphenol), 4,4'-butylidenebis(3-methyl-6-tert-butylphenol), 4,4'-thiobis(3-methyl-6-tert-butylphenol), 4-tert-butylpyrocatechol, monomethyl ether of hydroquinone, 2,6-di-tert-butyl-p-cresol, 1,1,3-tris(2-methyl-4-hydroxy-5-tert-butylphenyl)butane, and 2,4,6-tetraaminophenol.

19. A method of treating a substrate, the method comprising the step of:

(I) applying a mixture of:

(A) 100 weight parts of dimethylpolysiloxane having a viscosity of 3 to 30 $mm^2/s$ at 25° C.;

(B) 0.5 to 50 weight parts of a polyoxyalkylene-functional diorganopolysiloxane having the formula:

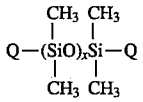

wherein Q is a group having the formula:

$$-RO(C_3H_6O)_a(C_2H_4O)_bR^1$$

wherein R denotes an alkylene group having from 2 to 5 carbon atoms, $R^1$ is a radical selected from the group consisting of a hydrogen atom, an alkyl group having from 1 to 6 carbon atoms, a $-COCH^3$ group, and $-COR^2COOH$ groups wherein $R^2$ is a divalent hydrocarbon group having from 1 to 15 carbon atoms, a has a value of 1 to 15, b has a value of 1 to 15, with the proviso that the ratio of a to b is from 0.1 to 10, the units expressed by $(C_3H_6O)_a$ in the formula constitute a block, the units expressed by $(C_2H_4O)_b$ constitute a block, and x has a value of at least 1; and (C) 0.003 to 1 weight parts of an antioxidant selected from the group consisting of:

(i) an amine-containing antioxidant;

(ii) a phenol-containing antioxidant; and (iii) a mixture of (i) and (ii) to a substrate.

20. A method according to claim 19, wherein the method further comprises heating the substrate after step (I).

21. A method according to claim 19, wherein the substrate is a fiber.

22. A method according to claim 21, wherein the fiber is selected from wool, silk, flax, cotton, angora, mohair, rayon, bemberg, acetate, polyester, polyamide, polyacrylonitrile, polyvinyl chloride, vinylon, polyethylene, polypropylene, or spandex.

* * * * *